US007530791B2

(12) United States Patent
Douville et al.

(10) Patent No.: US 7,530,791 B2
(45) Date of Patent: May 12, 2009

(54) TURBINE BLADE RETAINING APPARATUS

(75) Inventors: Benoit Douville, Saint-Hubert (CA); Nicholas Grivas, Dollard-des-Ormeaux (CA); Jean Chamoun, La Prairie (CA)

(73) Assignee: Pratt & Whitney Canada Corp., Longguquil, Quebec (CA)

( * ) Notice: Subject to any disclaimer, the term of this patent is extended or adjusted under 35 U.S.C. 154(b) by 199 days.

(21) Appl. No.: 11/313,843

(22) Filed: Dec. 22, 2005

(65) Prior Publication Data

US 2007/0148002 A1 Jun. 28, 2007

(51) Int. Cl.
*F01D 5/32* (2006.01)

(52) U.S. Cl. ..... 416/220 R; 416/248

(58) Field of Classification Search ..... 416/220 R, 416/204 A, 248

See application file for complete search history.

(56) References Cited

U.S. PATENT DOCUMENTS 2,846,184 A 8/1958 Tournere
2,994,507 A 8/1961 Keller et al.
3,728,042 A * 4/1973 Hugoson et al. ..... 416/95
3,748,060 A * 7/1973 Hugoson et al. ..... 416/92
3,888,601 A 6/1975 Glassburn
4,221,542 A 9/1980 Acres et al.
4,389,161 A 6/1983 Brumen
4,483,661 A * 11/1984 Manharth et al. ..... 416/220 R
4,566,857 A 1/1986 Brumen
4,872,810 A 10/1989 Brown et al.
5,067,877 A * 11/1991 Youssef ..... 416/220 R
5,112,193 A * 5/1992 Greer et al. ..... 416/220 R
5,131,814 A 7/1992 Przytulski et al.
5,151,013 A 9/1992 Moore
5,211,536 A 5/1993 Ackerman et al.
5,256,035 A 10/1993 Norris et al.
5,257,909 A 11/1993 Glynn et al.
5,271,714 A 12/1993 Shepherd et al.
5,302,086 A 4/1994 Kulesa et al.
5,318,405 A 6/1994 Meade et al.
6,488,473 B1 12/2002 Lee et al.
6,902,376 B2 6/2005 Gautreau et al.

* cited by examiner

*Primary Examiner*—Ninh H Nguyen
(74) *Attorney, Agent, or Firm*—Ogilvy Renault LLP

(57) ABSTRACT

An apparatus for retaining blade to a rotor disc of turbine engines includes a positioning member integrally for stopping the root of the blade when sliding into an attachment slot of the rotor disc, and a locking apparatus for retaining the root of the blade in the attachment slots.

20 Claims, 3 Drawing Sheets

TURBINE BLADE RETAINING APPARATUS

TECHNICAL FIELD

The invention relates generally to gas turbine engines, and more particularly, to an improved blade retaining apparatus for attachment of a turbine blade to a rotor disc of gas turbine engines.

BACKGROUND OF THE ART

A conventional gas turbine engine includes various rotor blades in the fan, compressor and turbine sections thereof, which are removably mounted to respective rotor discs. Each of the rotor blades includes a blade root at the radially inner end thereof. Each of the blade roots conventionally includes one or more pairs of lobes which can axially slid into and be retained in one of a plurality of axially extending attachment slots defined in the periphery of the rotor disc. Various of blade retaining apparatuses are conventionally used to affix turbine blades to a rotor disc of a gas turbine engine. Conventionally, blade retaining apparatuses do not provide sealing functions to reduce gas leakages through gaps between blade roots and disc fixings. Furthermore, when a blade root slides into an attachment slot of the rotor disc for assembly of the turbine rotor, it usually requires an axial alignment of the blade with the rotor disc before a blade retaining apparatus can be placed in place.

Accordingly, there is a need to provide an improved blade retaining apparatus for turbine assemblies of gas turbine engines in order to meet the demanding requirements of various aspects of high efficiency gas turbine engines.

SUMMARY OF THE INVENTION

It is therefore an object of the present invention to provide an improved blade retaining for a rotor assembly of a gas turbine engine.

In one aspect, the present invention provides an apparatus for retaining a blade to a rotor disc of turbine engines, the blade having a root radially engaged in a complementary attachment slot extending substantially axially in a periphery of the rotor disc. The apparatus comprises a positioning member integrally affixed to the rotor disc at a first side thereof for stopping the root when sliding into the attachment slot of the rotor disc. Means are provided for both axially retaining the root of the blade in the attachment slot and sealing gaps between the root and the attachment slot at least at a lower portion of the root.

In another aspect, the present invention provides a rotor assembly for gas turbine engines. The rotor assembly includes a rotor disc having a plurality of circumferentially spaced and substantially axial attachment slots defined in a periphery of the rotor disc, and a plurality of blades each having a complementary root thereof radially engaged in one of the attachment slots. The rotor assembly comprises a plurality of tabs integrated with the rotor disc at a first side thereof to stop a further movement when the roots of the blades individually slide from a second side of the rotor disc into the attachment slots and are in place within the individual attachment slots. A plurality of locking member retainers are provided, each affixed to one of the blades at an end thereof. There are also provided, a plurality of locking members each retained in one of the locking member retainers to prevent movement of the individual roots of the blades toward the second side of the rotor disc when the roots are in place within the attachment slots Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
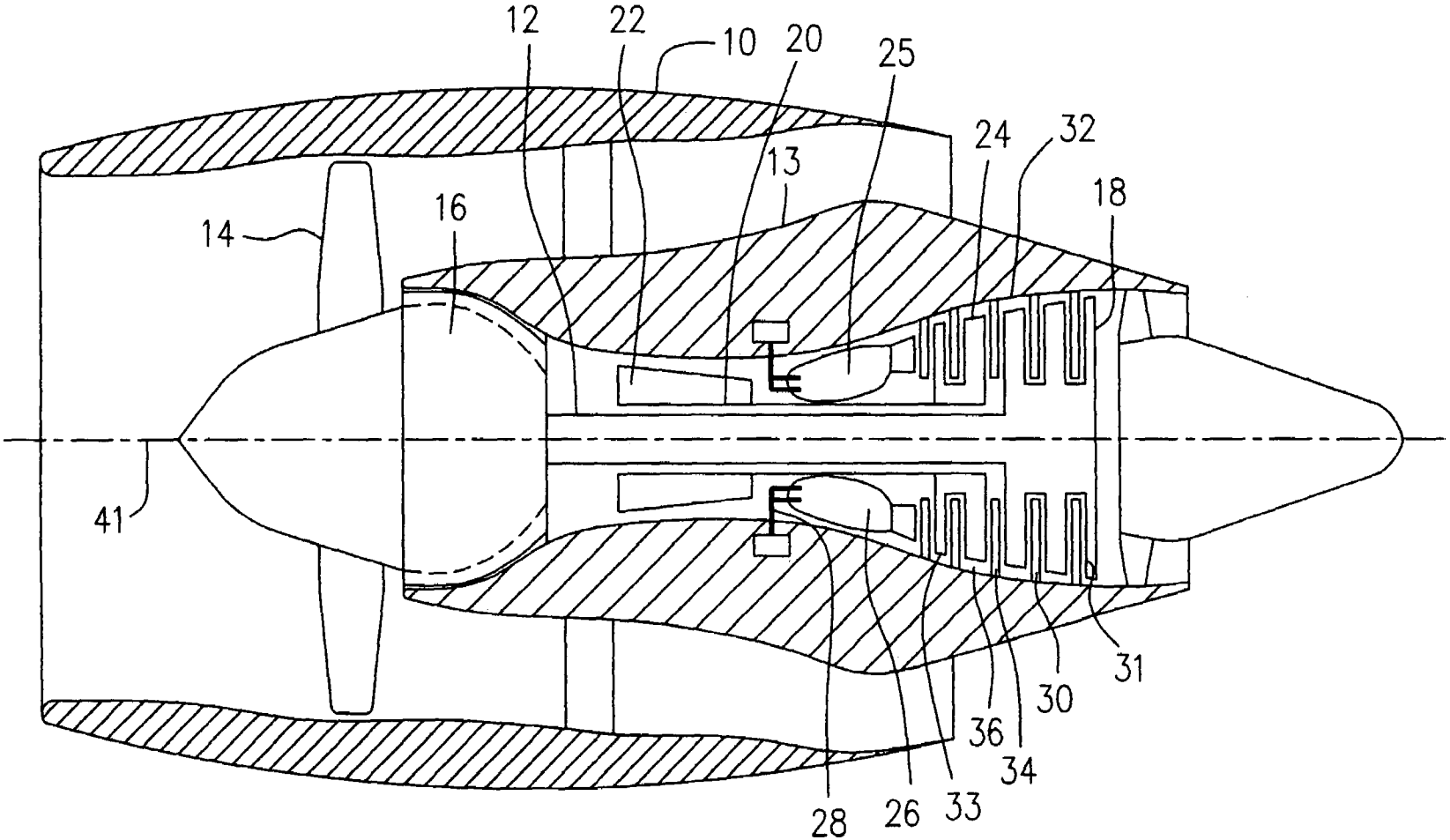
FIG. 1 is a schematic cross-sectional view of a turbofan gas turbine engine, as an example illustrating an application of the present invention.

Referring to FIG. 1, a turbofan gas turbine engine incorporating an embodiment of the present invention is presented as an example of the application of the present invention and includes a housing or a nacelle 10, a core casing 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The core casing 13 surrounds the low and high pressure spool assemblies 12 and 20 in order to define a main fluid path (not indicated) therethrough. In the main fluid path there is provided a combustor seen generally at 25 with fuel injecting means 28 to constitute a gas generator section 26. The compressor assemblies 16 and 22 drive a main air flow (not indicated) along the main fluid path and provide a cooling air source. The low and high pressure turbine assemblies 18, 24 include a plurality of stator vane stages 30 and rotor stages 31. Each rotor stage 31 has a plurality of rotor blades 33 rotatably mounted within a turbine shroud assembly 32 and each stator vane stage 30 includes a turbine ring assembly 34 which is positioned immediately upstream and/or downstream of rotor stage 31, for directing hot combustion gases into or out of a section of an annular gas path 36 which is in turn a section of the main fluid path downstream of the gas generator section 26, and through the stator vane stage 30, and rotor stage 31.

Figure 2:
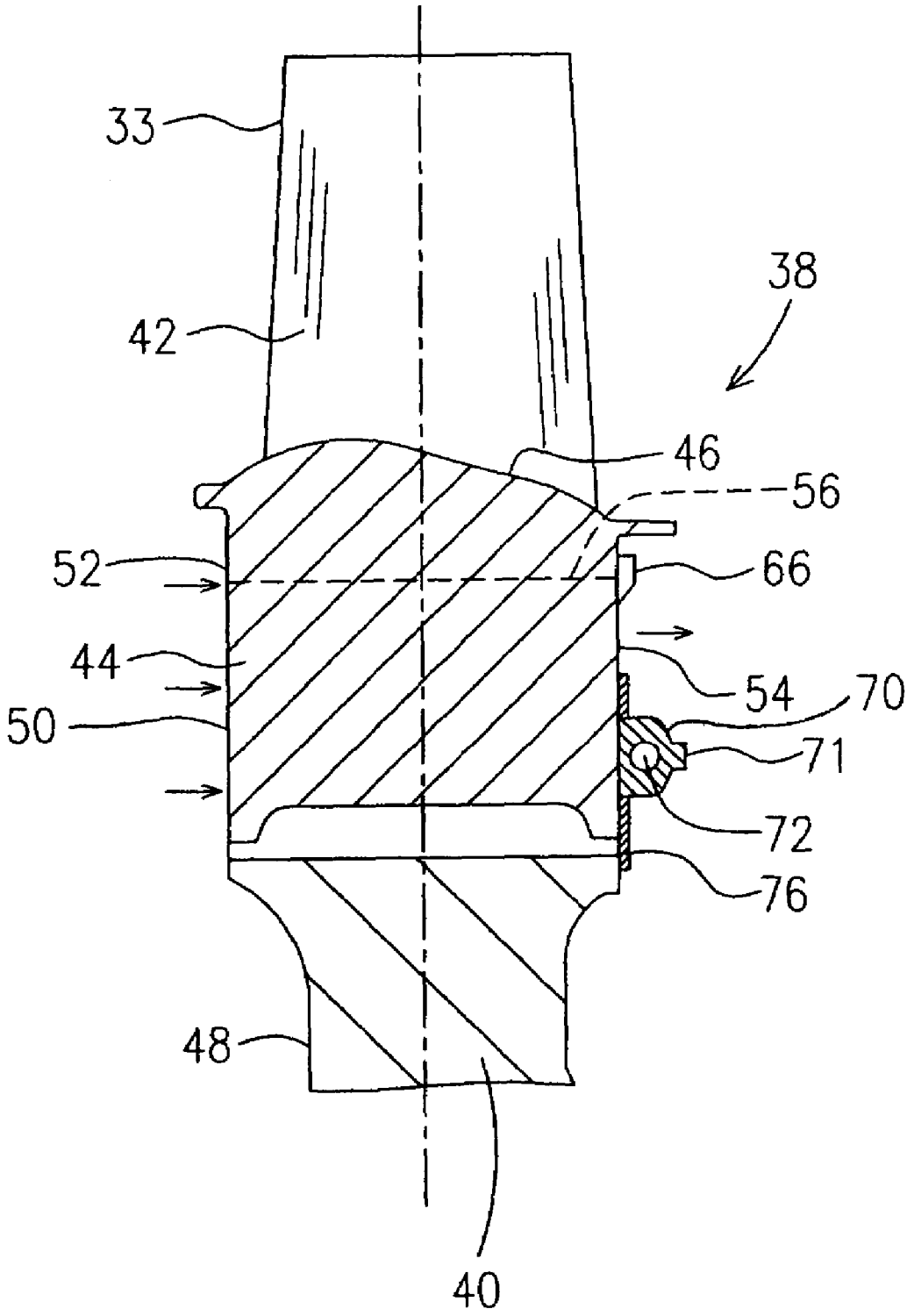
FIG. 2 is a schematic partial cross-sectional view of a turbine rotor assembly of the engine of FIG. 1, showing one embodiment of the present invention.

Referring to FIGS. 1 and 2, a rotor assembly, for example, a turbine rotor assembly 38 in a first rotor stage 31 of the high pressure turbine assembly 24, is described herein according to one embodiment of the present invention. The turbine rotor assembly 38 includes a turbine rotor disc 40 mounted to a rotating shaft (not indicated) of the high pressure spool assembly 20 and is rotatable about a longitudinal axis 41 of the engine, which is also the longitudinal axis of the turbine rotor assembly 38. An array of rotor blades 33 (only one shown in FIG. 2) extend outwardly from a periphery of the turbine rotor disc 40. Each of the rotor blades 33 includes an airfoil section 42, a root section 44 and platform segments 46 extending laterally from opposed sides of the airfoil section 42 into opposing relationship with corresponding platform segments 46 of adjacent rotor blades 33.

Figure 4:
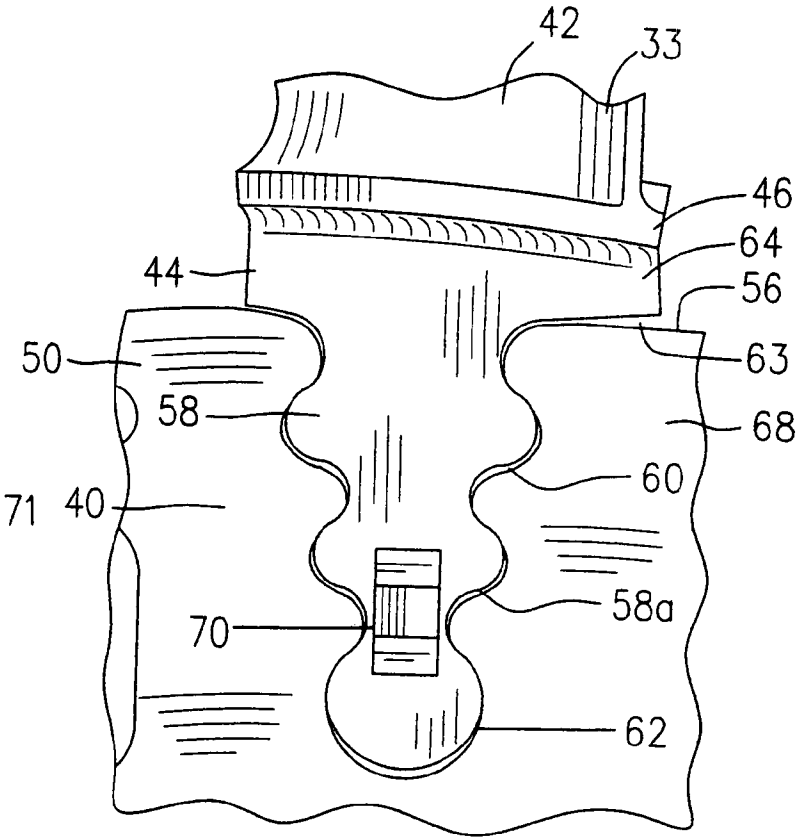
FIG. 4 is a partial rear side elevational view of the turbine rotor assembly of FIG. 2, with tabs, rivets and plates removed to show the gaps between the root of a blade and the disc fittings, a major section of which will be covered by the tabs and plates shown in FIG. 3.
Figure 3:
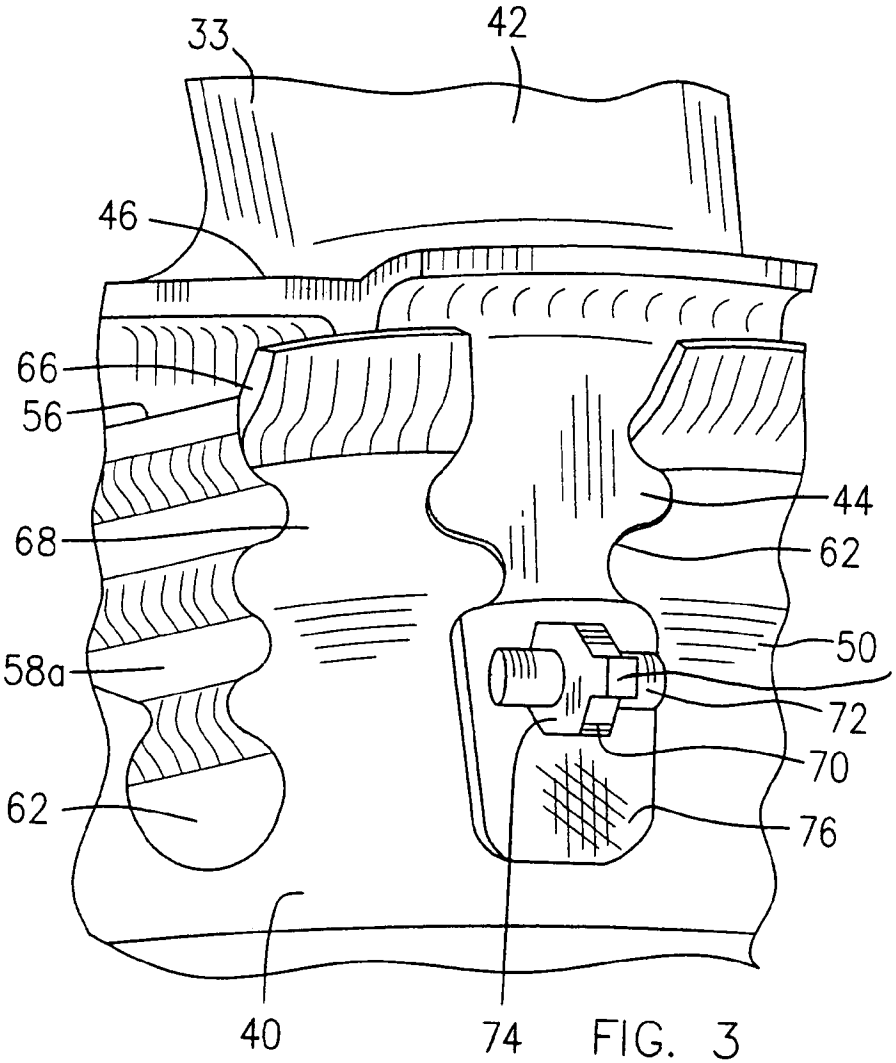
FIG. 3, is a partial rear perspective view of the turbine rotor assembly of FIG. 2 with an adjacent blade removed, showing an attachment slot and the blade retaining apparatus located at the rear side of the rotor assembly.

The turbine rotor assembly 38 is described in greater detail with reference to FIGS. 2-4. The turbine rotor disc 40 includes a web section 48 extending radially outwardly from a hub (not shown) which is mounted to the rotating shaft (not indicated) of the high pressure spool assembly 20 of FIG. 1, and a rim section 50 extending radially outward from the web section 48. Rim section 50 has an axial thickness defined by a front side 52 and a rear side 54. Rim section 50 also defines an outer periphery 56.

Root section 44 of each turbine root blade 33 includes at least one projection on each of opposed sides thereof, which in this embodiment are, for example, formed by a series of lobes 58, having progressively decreasing circumferential widths from the radially outermost lobe 58 ("top lobe") to the radially innermost lobe 58 ("bottom lobe"), with the radially central lobe 58 ("mid lobe") disposed therebetween and having an intermediate lobe width. The root section 44 of such a multi-lobed type is often referred to as a firtree, because of this characteristic shape.

The turbine rotor disc 40 further includes a plurality of attachment slots 62 defined in the periphery 56 thereof and circumferentially spaced apart one from another. Each of the attachment slots 62 extend substantially axially through the periphery of the turbine rotor disc 40, which in this embodiment, is the entire axial thickness of the rim section 50. The axial attachment slot 62 includes a series of axial recesses or fillets 58*a* defined in opposite side walls (not indicated) of attachment slot 62, which are substantially complimentary in both shape and direction to the firtree of root sections 44, so as to form abutting retaining surfaces of the respective root section 44 and attachment slot 62 for radially retaining blade 33 in the turbine rotor assembly 38 against centrifugal forces caused by high speed rotation of the turbine rotor assembly 38. The abutting retaining surfaces extend substantially along both the entire axial length of the turbine rotor blade 33 and the axial thickness of the rim section 50 of the turbine rotor disc 40. It should be noted that the firtree of root section 44 is loosely fitted in the attachment slot 62 to allow the rotor blade 33 to be self adjusted in position under the centrifugal forces during operation in order to significantly reduce or eliminate stresses on the root section 44 caused by inappropriate attachment. Therefore, during operation, there are gaps between root section 44 of the blade 33 and the rotor disc 40, in particular, gaps 60 between the bottom surfaces of top, mid and bottom lobes 58 and the respective adjacent surfaces of fillets 58*a*, and gaps 63 between bottom surfaces of upper portions 64 of the root section 44 at opposite sides thereof and an outer surface of the periphery 56 of the turbine rotor disc 40. Those gaps are more clearly shown in FIG. 4.

An apparatus of the present invention is provided for retaining the rotor blades 33 axially in place relative to the turbine rotor disc 40. In one embodiment of the present invention, the apparatus includes positioning members, for example, a plurality of tabs 66 integrated with the turbine rotor disc 40 at, for example, the rear side 54 thereof in order to stop a further movement when the root sections 44 of the rotor blades 33 individually slide from the front side 52 of the turbine rotor disc 40 into the attachment slots 62 and are in place within the individual attachment slots 62. The tabs 66 extend preferably radially out of the periphery of the turbine rotor disc 40 from respective lands 68 located between the circumferentially spaced attachment slots 62. The tabs further preferably extend circumferentially along a full width of the respective lands 68 to substantially cover the gaps between the bottom surface of the upper portions 64 of the root sections 44 and adjacent portions of the periphery 56 of the turbine rotor disc 40. When the root section 44 of one blade 33 slides into the attachment slot 62 of the turbine rotor disc 40 and is stopped by the tabs 66, the rotor blade 33 is positioned axially in place relative to the turbine rotor disc 40, and the rear end (not indicated) of the root section 44 is substantially flush with the rear side 54 of the turbine rotor disc 40 or at least is not protruding from the rear side 54 of the turbine rotor disc 40, as shown in FIG. 2.

The apparatus of the present invention further provides means for both retaining the root sections 44 of the rotor blades 33 in the respective attachment slots 62 and sealing the gaps 60 between the root sections 44 and the attachment slots 62 at least at a lower portion of the respective root sections 44. In one of the embodiments of the present invention, such means include a plurality of locking member retainers, for example rivet retainers 70, each affixed to the rear end of the root section 44 of the rotor blade 33 and preferably including a protrusion 71, and a plurality of locking members, for example rivets 72, each received in one of the rivet retainers 70, in order to prevent movement of the individual root sections 44 of the rotor blades 33 towards the front side 52 of the rim section 50 when the root sections 44 of the rotor blades 33 are in place within the respective attachment slots 62. Preferably, each of the rivet retainers 70 includes a nut-like body affixed to the rear end of the root section 44 of the rotor blade 33 and has opposed side surfaces 74 thereof extending substantially perpendicular to the rear end of the root section 44. A hole (not indicated) is defined through the rivet retainer 70 between the opposed side surfaces 74 for receiving the rivet 72 in substantially a tangential direction relative to the turbine rotor assembly 38.

A retaining plate 76 is preferably further provided to be attached to the rear end of the root section 44 of each rotor blade 33. For example, the retaining plate 76 defines an opening (not indicated) to allow the rivet retainer 70 to extend therethrough when the retaining plate 76 is attached to the rear end of the root section 44. After the retaining plate 36 is attached to the rear end of the root section 44, the rivet 72 is inserted into the hole of the rivet retainer 70 and is deformed in a riveting operation to force the retaining plate 76 to contact the rear side 54 of the rim section 50 of the turbine rotor disc 40. The retaining plate 76 is sized to be at least greater than a minimum width of the root section 44 between the mid and bottom lobes 58, but is preferably sized to cover more gaps between the root sections 44 and the turbine rotor disc 40, so as to cover the gaps 60 between the bottom surface of the bottom and mid lobes 58 of the root section 44 and the adjacent surfaces of attachment slots 62, as illustrated in FIG. 3. The retaining plate 76 prevents withdrawal of the root section 44 out of the attachment slot 62, from the front side 52 of the rim section 50.

In operation the tabs 66 and the retaining plates 76 with deformed rivets 72, provide not only a retaining function to axially retain the root sections of rotor blades 33 in the respective attachment slots 62 of the turbine rotor disc 40, but also provide a certain degree of sealing function to reduce pressure loss through the gaps 60 between the root sections 44 of rotor blades 33 and the attachment slots 62 of the turbine rotor disc 40, and through the gaps 63 between the upper portions of the root section 44 and the periphery 56 of the turbine rotor disc 40, as schematically illustrated by a number of arrows in FIG. 2. Therefore, the engine's overall performance is improved.

During an assembly procedure, the tabs 66 function as stop members for axially positioning the root sections 44 of the rotor blades 33 in place within the respective attachment slots 62, thereby eliminating the need for axial alignments in order to attach retaining elements, as required in many circumstances in the prior art. Furthermore, the retaining plates 76 protect the root sections 44 of the rotor blades 33 and the rim section 50 of the turbine rotor disc 40 from scratching or other damages which may be cause by the riveting operation.

Referring again to FIGS. 2 and 3, protrusion 71 of rivet retainer 70 can be used in rotor balancing—that is, material may be removed, as necessary, from one or more protrusions 71 around the periphery of the rotor assembly, to balance the rotor. Alternately or additionally, the size and/or material selection of rivet 72 and/or retaining plate 76 may be used in rotor balancing, as will be understood by the skilled reader.

The above description is meant to be exemplary only, and one skilled in the art will recognize that changes may be made to the embodiments described without departing from the scope of the invention disclosed. For example, retaining plates 76 may be sized larger than those illustrated and described in the above-embodiments of the present invention, in order to substantially cover all gaps 58 between the root sections 44 and the attachment slots 62. Locking members other than rivets such as clips in various other types may be used and complimentary clip retainers may be used to replace the rivet retainers 70. The entire retaining apparatus of the present invention may be located at either side of the rotor assembly depending on how the attachment slots and the root sections of the rotor blades are configured. Moreover, the retaining apparatus of the present invention can be applied to gas turbine engines other than a turbofan type which is only an example to illustrate one application of the present invention. Still other modifications which fall within the scope of the present invention will be apparent to those skilled in the art, in light of a review of this disclosure, and such modifications are intended to fall within the appended claims.

The invention claimed is:

1. An apparatus for retaining an airfoil blade to a rotor disc of a gas turbine engine, the blade having a root radially engaged in a complementary attachment slot extending substantially axially in a periphery of the rotor disc, the apparatus comprising:

a positioning member integrally affixed to the rotor disc at a first side thereof for limiting axial movement of blade in a direction from a second side of the rotor disc opposite to the first side; and means for both restraining axial movement of the root of the blade in the attachment slot towards the second side of the rotor disc and sealing gaps between the root and the attachment slot at least at a lower portion of the root, wherein the means abuts the first side of the rotor disc, and wherein the means is attached to a first side end of the root of the blade.

2. The apparatus as defined in claim 1 wherein the means comprises a locking member retainer affixed to said end of the root and a locking member adapted to be retained in the locking member retainer to abut the first side of the rotor disc.

3. The apparatus as defined in claim 1 wherein the means comprises a rivet retainer affixed to said end of the root and a rivet retained in the rivet retainer.

4. The apparatus as defined in claim 3 wherein the means further comprises a plate secured by the rivet to the rivet retainer to cover the gaps between the root and the attachment slot at least at the lower portion of the root.

5. The apparatus as defined in claim 1 wherein the means further comprises a sealing member abutting the first side of the rotor disc to cover the gaps between the root and the attachment slot at least at the lower portion of the root.

6. A rotor assembly for a gas turbine engine, the rotor assembly including a rotor disc having a plurality of circumferentially spaced and substantially axial attachment slots defined in a periphery of the rotor disc, and a plurality of blades each having a complementary root thereof radially engaged in one of the attachment slots, the rotor assembly comprising a plurality of circumferentially spaced tabs integrated with the rotor disc at a first side thereof to limit axial movement of the blades in a direction defined from a second side of the rotor disc toward the first side, a locking member retainer affixed to each one of the blades at a first side end thereof, and a plurality of locking members each retained in one of the locking member retainers to limit axial movement of the blades toward the second side of the rotor disc.

7. The rotor assembly as defined in claim 6 wherein the tabs extend radially outwardly from the periphery of the rotor disc at respective lands located between the circumferentially spaced attachment slots.

8. The rotor assembly as defined in claim 7 wherein the tabs extend circumferentially along a full width of the respective lands to substantially cover gaps between the roots and portions of the periphery of the rotor disc.

9. The rotor assembly as defined in claim 6 wherein the locking members comprise a plurality of rivets each retained in the locking member retainer.

10. The rotor assembly as defined in claim 9 wherein the locking member retainers project axially from the end of the respective roots and define respective holes there through for receiving the individual rivets in a substantially tangential direction of the rotor assembly.

11. The apparatus of claim 9 wherein the locking retainer extends axially away from the first side and the rivet is mounted generally tangentially with respect to the rotor.

12. The rotor assembly as defined in claim 6 further comprising a plurality of plates attached to the end of the respective roots and secured by the locking members and locking member retainers to cover gaps between individual roots and attachment slots at lower portions thereof.

13. An apparatus for retaining an airfoil blade to a rotor disc of a gas turbine engine, the blade having a root engaged in a complementary attachment slot extending generally axially in a periphery of the rotor disc, the apparatus comprising:

a positioning member integrally affixed to the rotor disc adjacent a first side of the disc, the positioning member extending radially and outwardly from the periphery of the rotor disc adapted to limit axial movement of the root engaged in the attachment slot; and a locking apparatus attached to an end of the root of the blade, the locking apparatus abutting the first side of the rotor disc to thereby prevent the root of the blade from moving toward a second side of the rotor disc.

14. The apparatus as defined in claim 13, wherein the positioning member extends radially and outwardly from the periphery of the rotor disc and substantially covers a gap between an upper side portion of the root and a portion of the periphery of the rotor disc.

15. The apparatus as defined in claim 13 wherein the locking apparatus comprises a locking member retainer affixed to said end of the root and a locking member adapted to be retained in the locking member retainer to abut the first side of the rotor disc.

16. The apparatus as defined in claim 13 wherein the locking apparatus comprises a rivet retainer affixed to said end of the root and a rivet retained in the rivet retainer.

17. The apparatus as defined in claim 16 wherein the means further comprises a plate secured by the rivet to the rivet retainer to cover the gaps between the root and the attachment slot at least at the lower portion of the root.

18. The apparatus of claim 16 wherein the rivet retainer extends axially away from the first side and the rivet is mounted generally tangentially with respect to the rotor.

19. The apparatus as defined in claim 13 wherein the locking apparatus further comprises a sealing member abutting the first side of the rotor disc to cover the gaps between the root and the attachment slot at least at the lower portion of the root.

20. The apparatus of claim 13 further comprising means for rotor balancing integrally provided thereon.

* * * * *